United States Patent [19]

Kellogg et al.

[11] 4,332,351

[45] Jun. 1, 1982

[54] BLOOD FRACTION EXTRACTING CENTRIFUGE

[75] Inventors: Robert M. Kellogg; Victor R. Kruger, both of Washington Crossing, Pa.

[73] Assignee: International Business Machines Corporation, Armonk, N.Y.

[21] Appl. No.: 189,409

[22] Filed: Sep. 22, 1980

[51] Int. Cl.[3] ..... B04B 1/04; B04B 11/06

[52] U.S. Cl. ..... 233/38; 233/44; 233/47 R

[58] Field of Search ..... 233/27, 29, 30, 32, 233/34, 38, 39, 47 R, 40, 41, 42, 46, 27

[56] References Cited

U.S. PATENT DOCUMENTS

| | | | |
|---|---|---|---|
| 379,134 | 3/1888 | Shepard | 233/32 |
| 489,198 | 1/1893 | Peck | 233/46 |
| 3,326,458 | 6/1965 | Meryman | 233/26 |
| 4,120,448 | 10/1978 | Cullis | 233/46 X |

*Primary Examiner*—Harvey C. Hornsby

*Assistant Examiner*—Joseph M. Pitko

*Attorney, Agent, or Firm*—Paul M. Brannen

[57] ABSTRACT

A centrifuge structure for automatically separating a plurality of aliquot samples of blood plasma for testing from an initial sample of whole blood. A centrifuge bowl is provided with a bottom surface sloping upwardly and outwardly and joined to a vertical circular outer wall. A plurality of radially extending vertical septa or partitions divide the outer portion of the bowl into a plurality of radially extending chambers. Each of these chambers is provided with an exit port in the bottom surface. Whole blood placed in the bowl is forced radially outward by the centrifugal action of the bowl when rotated, and separates into different fractions. The selected fractions are moved to the vicinity of the exit ports by selectively changing the rotational velocity of the centrifuge and are then valved to other containers by opening valves connected to the exit ports.

4 Claims, 6 Drawing Figures

BLOOD FRACTION EXTRACTING CENTRIFUGE

BACKGROUND OF THE INVENTION

1. Field of the Invention

This invention relates to centrifuging apparatus and particularly to centrifuging apparatus for providing a plurality of samples of a blood fraction for subsequent processing and/or testing. More particularly, the invention relates to a rotary centrifuge which is provided with a plurality of radially extending chambers connected to a common central well, from which blood is moved by centrifugal action into the plurality of chambers, and separated into appropriate fractions. Exit ports located one in each of the chambers are arranged to drain the desired fraction of blood into another location upon the operation of a valve connected with the port.

2. Description of the Prior Art

Centrifuges containing radial partitions or septa and associated extraction ports are relatively common in the prior art. Examples of such centrifuges are shown in U.S. Pat. Nos. 3,069,074; 3,072,323; 3,484,040; 3,847,327; and 4,005,817. None of these known arrangements are arranged to define a plurality of measuring regions or chambers such that many equal or aliquot samples of blood plasma will be obtained from one common blood sample. The prior art centrifuges such as shown in the above references utilize radial walls for a variety of different reasons, such as to overcome inherent friction of the substance to be separated and the like, and are not arranged to provide equal samples from a common input sample. Also, of course, none of the samples indicated in the above group are applied specifically to obtaining pluralities of samples of blood.

SUMMARY OF THE INVENTION

It is accordingly a principal object of the present invention to provide an improved centrifuge arrangement which will, from a common blood sample, provide a plurality of samples of equal amount of a specific fraction of the blood, for example, the plasma.

Another object of the invention is to provide an improved centrifugal arrangement for separating a selected fraction of whole blood in a plurality of equal amounts for blood analysis.

Still a further object of the invention is to provide a more economical arrangement for providing a plurality of blood fractions from a common sample.

Briefly described the present invention contemplates a centrifuge bowl having a bottom which extends radially outward and at an upward angle, and terminates at the outer wall of the centrifuge which is vertical. The interior of the bowl is divided into a plurality of equal volume chambers by a plurality of vertically extending septa or partitions. Thus, at the center of the bowl, there is a common well or supply chamber into which a whole blood sample may be introduced. When the centrifuge bowl is rotated in the usual fashion, the blood moves upwardly and outwardly from the center of the centrifuge into the plurality of chambers, and further separates into fractions in accordance with the density of those fractions. Associated with each of the radial chambers is an exit port provided with a controlled valve, which is arranged so that after sufficient centrifuging has separated the blood into its desired components, the exit ports may be selectively opened to drain the component residing in the vicinity of the exit port into another chamber for further processing and/or analysis.

The foregoing and other objects, features and advantages of the invention will be apparent from the following more particular description of a preferred embodiment of the invention, as illustrated in the accompanied drawings.

BRIEF DESCRIPTION OF THE DRAWINGS

Similar reference characters refer to similar parts in each of the several views.

DETAILED DESCRIPTION OF A PREFERRED EMBODIMENT

Figure 1:
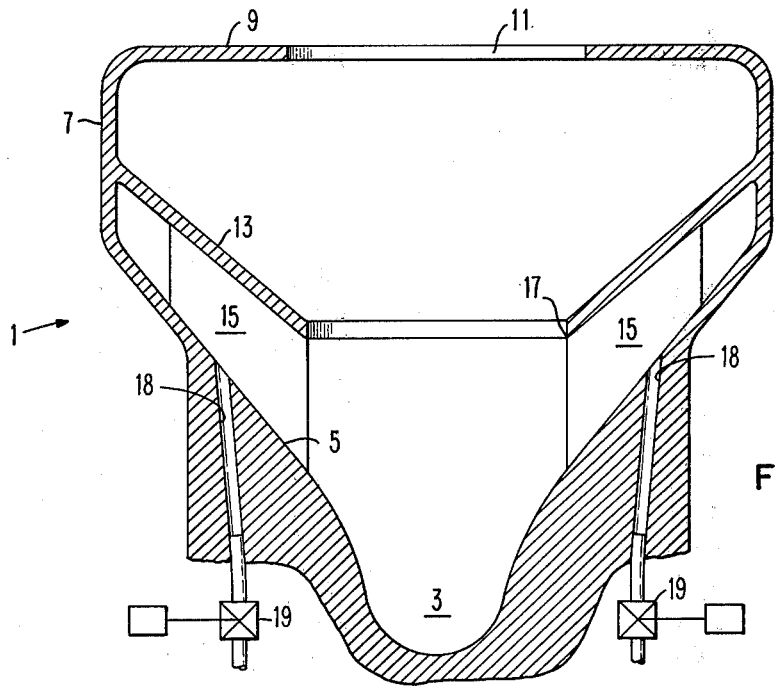
FIG. 1 is a cross-section elevational view, in schematic form, showing the basic configuration of a preferred embodiment of the invention.
Figure 2:
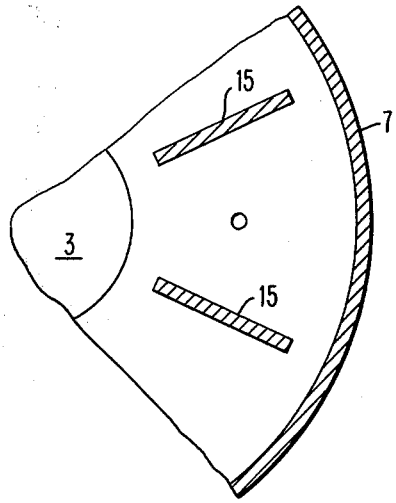
FIG. 2 is a sectional view taken across a portion of the illustration in FIG. 1.

Referring to FIG. 1 of the drawings, reference character 1 designates generally a centrifuge bowl which is circular, having a central well 3 into which a sample of whole blood is entered, the bottom surface of the well being contoured as shown to provide an upwardly and outwardly sloping surface 5, which extends out to join with the vertical circular upper wall 7 of the centrifuge bowl. The upper portion of the wall is folded or molded in a reentrant manner to provide a top surface 9 having a central opening 11 for entering the blood sample into the centrifuge.

A partition 13 extends radially outward from the vicinity of the sample well 3 and adjoins the outer circular wall 7, as shown, to provide an overflow barrier. The region between the bottom surface 5 and the partition 13 forms a measuring region which is divided into a plurality of radial chambers by a plurality of septa or partitions 15 which extend outwardly from the center, but which stop short of the outer wall 7.

Thus, it will be seen that the rotor bowl 1 is provided with three distinct regions, namely, the sample well or chamber 3, the plurality of measuring regions defined by the surface 5, partition 13, and the septa 15, and an overflow region constituting the region above the partition 13 and extending outwardly to the inner surface of the wall 7. These regions are proportioned volumetrically so that the sample well is larger than the combined volume of the multiple measuring portions. The volume of the overflow region is such that its volume together with that of the measuring regions is somewhat larger than that of the sample well so that it is insured that no blood from the sample can escape from the rotor while the centrifuge is in operation.

In operation, anti-coagulated whole blood is introduced into the stationary rotor through the top opening 11 into the sample well 3. The size of the blood sample is such that its free or top surface does not touch the metering edge 17 of the partition 13. This insures that no air will be trapped in the measuring regions as the rotor is brought up to its operating speed. The rotor is then started in rotation and as the speed of the rotor increases, the centrifugal force will cause the blood to flow up and out of the well, centrifugally filling the measuring regions. With the proportioning as described above, the measuring regions will completely fill with any excess blood passing over the metering edge 17 and over the top of the partition 13. The extraction ports 18 in each of the measuring regions are closed at this time by the associated valves 19. Note that the passages comprising the extraction ports 18 are sloped radially inward in the downward direction. This inward slope allows any cells that become entrapped in the port during sample loading or centrifugal blood flow to move upward and out of the port by centrifugal action.

After this primary fluid transfer has taken place, the rotor speed is further increased to cause blood separation into the plasma and the red and white cell portions. The open passage between each measuring region, that is between the edge of the septa 15 and the wall 7 insures that the red cell/plasma interface will be at the same radial location within each measuring region. There will be some radial variation in the radial location of the interface from sample-to-sample however, since the variation will be a function of the initial hematocrit of the blood sample, and accordingly the extraction ports are located to accommodate the blood within a predetermined hematocrit range.

After the separation of the blood fractions is complete, the extraction port valves 19 are opened allowing the plasma portion to flow centrifugally and/or by gravity flow to other locations in the centrifugal analyzer, which are not shown. The number and volume of the plasma samples so produced is determined principally by the number of septa and the radial location of the metering edge and extraction ports. The septa 15 further insure that each sample will have essentially the same volume by blocking any plasma crossflow from one measuring region to another. The extracted plasma samples may then be analyzed automatically in other portions of the centrifugal analyzer, which parts are not germaine to the present invention and hence are not shown or described.

Figure 3:
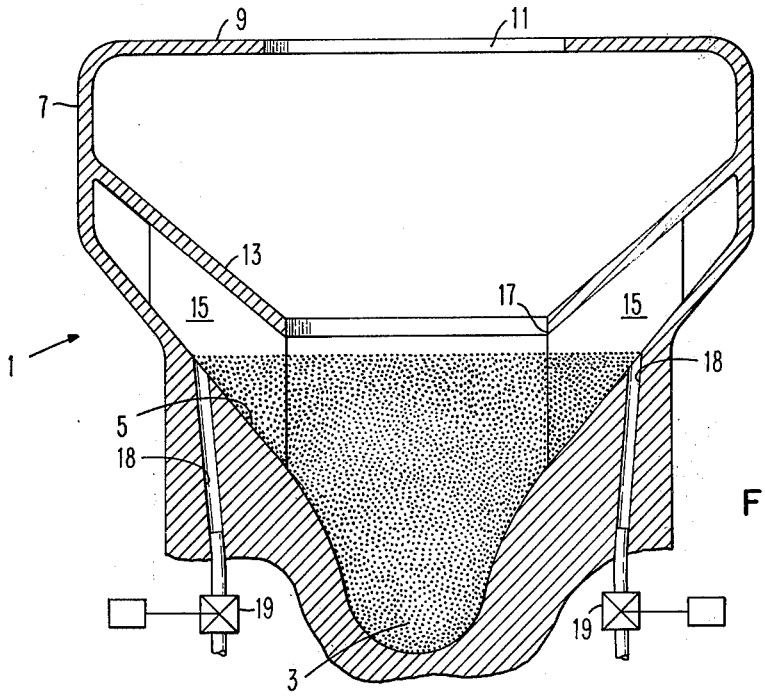
FIGS. 3, 4, 5 and 6 illustrate the operation of the centrifuge showing the locations of blood samples and blood fractions during the operation of the centrifuge.

FIG. 3 of the drawings shows a cross-sectional view of the rotor bowl according to the invention, with a blood sample occupying the sample well and with the rotor stationary. It will be noted that the upper surface of the blood sample is clear of the metering edge 17.

Figure 4:
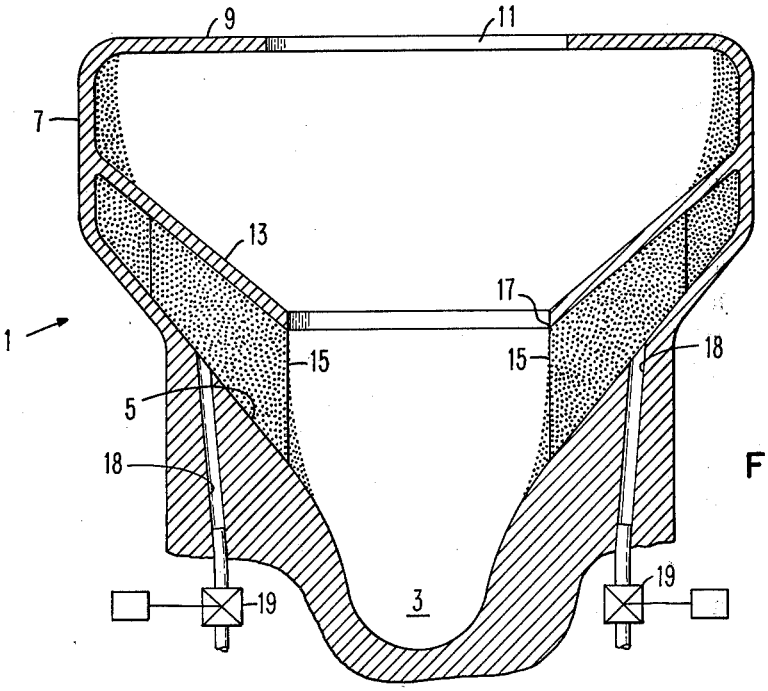

FIG. 4 shows a cross-sectional view of the centrifuge with the blood sample therein under conditions of low speed rotation. At this time the centrifugal force is sufficient to cause the blood sample to move upwardly and outward of the sample well into the measuring region, with any overflow amount being diverted by the metering edge and occupying the upper outward portion of the bowl above the partition 13. At this time, the rotational speed is not such that separation of the blood fractions occurs.

Figure 5:
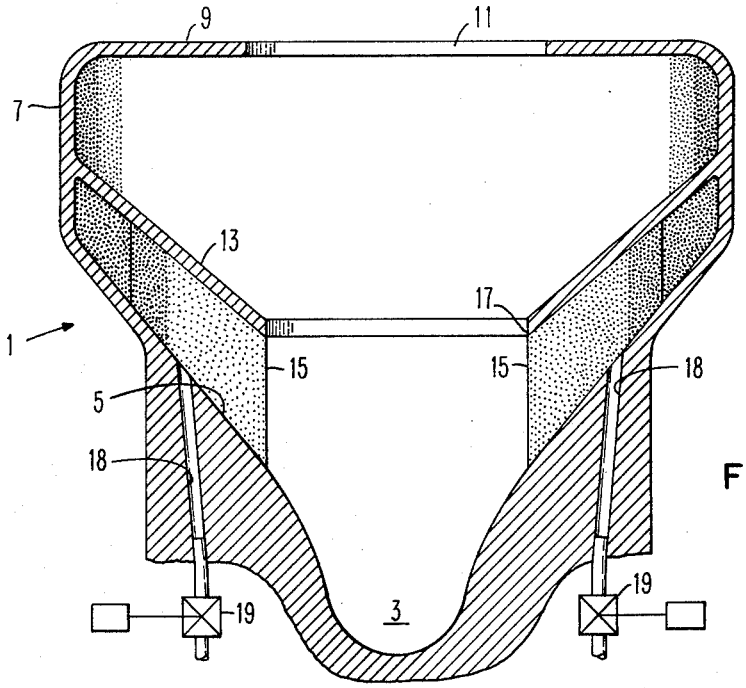
Figure 6:
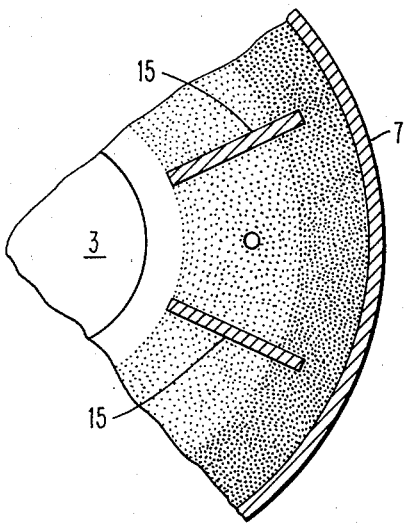

FIG. 5 shows the conditions of high speed rotation, in which the blood is now separated into the packed red cells and the plasma, as shown. As can be seen in FIG. 5 and in the sectional view of FIG. 6, the plasma occupies the portion of the measuring region in which the extraction port is located so that when the valve associated with the extraction port is opened, the sample plasma will be drained from that particular measuring region into another location within the centrifuge for further processing.

From the foregoing, it will be apparent that this invention provides a new and improved centrifugal analyzer structure in which a plurality of measured quantities of blood fractions can be obtained from a single sample of whole blood.

While the invention has been particularly shown and described with reference to a preferred embodiment thereof, it will be understood by those skilled in the art that various changes in form and details may be made without departing from the spirit and scope of the invention.

We claim:

1. A blood separation centrifuge for providing a plurality of plasma samples from a sample volume of whole blood, comprising, in combination, a centrifuge rotor element a central sample well in said rotor element a plurality of radially oriented sample chambers in said rotor element, each adapted to receive blood from said well in response to centrifugal force exerted on the blood in said well, said chambers being at least partially defined by a plurality of septa extending radially from a first locus disposed near the axis of the centrifuge to a second locus near the outer wall of the centrifuge and spaced from said outer wall to provide a communicating channel for said chambers, and a corresponding plurality of extraction ports, one for each sample chamber, for draining plasma from the associated chamber after the plasma has been separated by centrifugal force, said ports being spaced radially inward from the wall of the centrifuge by a predetermined distance representing the location of the plasma after its separation.

2. A blood separation centrifuge as claimed in claim 1, further including a plurality of valves, one for each said extraction part, for selectively drawing the plasma from the associated sample chamber.

3. A blood separation centrifuge as claimed in claim 1, in which said sample chambers are provided with a metering edge to limit the volume of the blood sample in said chambers.

4. A blood separation centrifuge as claimed in claim 1 further including an overflow region for collecting any excess portion of blood initially contained in said sample well.

* * * * *